US005198614A

United States Patent [19]

de la Haye et al.

[11] Patent Number: 5,198,614

[45] Date of Patent: Mar. 30, 1993

[54] MINE WITH A LAYING DEVICE FOR A SENSOR LINE

[75] Inventors: Johannes de la Haye, Kurten; Franz Strack, Cologne, both of Fed. Rep. of Germany

[73] Assignee: Dynamit Nobel Aktiengesellschaft, Troisdorf, Fed. Rep. of Germany

[21] Appl. No.: 812,008

[22] Filed: Dec. 23, 1991

[30] Foreign Application Priority Data

Dec. 24, 1990 [DE] Fed. Rep. of Germany ..... 4041767

[51] Int. Cl.[5] ..... F42B 23/16; F42B 23/24

[52] U.S. Cl. ..... 102/401; 102/425; 102/427

[58] Field of Search ..... 102/425, 424, 426, 427, 102/401, 404, 387, 489, 372, 373

[56] References Cited

U.S. PATENT DOCUMENTS

| | | | |
|---|---|---|---|
| 3,754,508 | 8/1973 | Dalton | 102/427 |
| 3,857,338 | 12/1974 | Bucklisch | 102/387 |
| 4,205,609 | 6/1980 | Sweeney et al. | 102/425 |
| 4,402,271 | 9/1983 | Heidmann et al. | 102/401 |
| 4,476,784 | 10/1984 | Reynes | 102/424 |
| 4,711,178 | 12/1987 | Argyrakis | 102/387 |
| 4,848,236 | 7/1989 | Hembise | 102/427 |
| 4,922,824 | 5/1990 | Schubart | 102/425 |
| 4,979,444 | 12/1990 | Schoffl | 102/401 |

FOREIGN PATENT DOCUMENTS

| | | | |
|---|---|---|---|
| 3338936 | 5/1985 | Fed. Rep. of Germany | 102/427 |
| 9012997 | 11/1990 | World Int. Prop. O. | 102/427 |

*Primary Examiner*—David H. Brown

*Attorney, Agent, or Firm*—Antonelli, Terry, Stout & Kraus

[57] ABSTRACT

In a mine capable of righting itself, laying devices for sensor lines are attached on the outside to the topside of a mine housing. During storage and during transport, the laying devices are, in their initial position, in close contact with the topside of the mine housing. Upon distribution of the mines over the terrain, the laying devices are spread away from the topside of the mine housing and transferred into their effective position so that the sensor lines can be ejected at an angle of about 45° inclined with respect to the vertical.

7 Claims, 3 Drawing Sheets

MINE WITH A LAYING DEVICE FOR A SENSOR LINE

BACKGROUND OF THE INVENTION

This invention relates to a mine equipped with at least one laying device for the placement of a sensor line, said at least one laying device being positioned on the top side of a housing of the mine.

Mines have been known, for example, as ballistic mines from DE 3,713,424 Cl. Such mines are ejected from missiles over the target area and righted into a more or less vertical position with the aid of righting elements which are activated only once the mine has come to rest on the ground of the terrain.

These mines, in ambush position, are to be triggered by the object to be combated (in most cases a tank); for this purpose, sensors are required, preferably at least one sensor line placed in the terrain, with an evaluating circuit in the mine. The term "sensor line" is understood to mean hereinbelow an active element or a passive element. Active elements, such as lightguide cables or piezo cables, generate a signal for triggering the mine when a vehicle rolls over them. Passive elements include lines or wires which transmit, upon contact with the vehicle to be contacted, a tensile force to a switch attached to the mine. Sensor lines are needed, in particular, in case of the so-called broad-area defense mines which, as contrasted with the classical mines, assume a position favorable for combating the target before they are triggered wherein they usually actively approach the target and preferably combat the target, e.g., vehicle, from above.

The ejection and distribution of the sensor lines must take place automatically and with high reliability. In accordance with DE 3,713,424 Cl, the ejection device or the distributing device is integrated into the housing of the mine for this purpose. In this structure, a relatively large amount of space is necessary since the device must be arranged at an angle of about 45° inclined with respect to the mine axis in order to be able to eject the sensor line under this angle and thus to attain maximum range. The lower the level at which the ejection device is arranged within the mine housing, the higher must be the energy for ejection so that the sensor line can be safely ejected and distributed even through additional shrubbery present on the terrain The energy stored in a spring in accordance with DE 3,713,424 Cl is frequently inadequate for this purpose.

SUMMARY OF THE INVENTION

The invention is based on the object of increasing, in a mine equipped with at least one laying device, the reliability of distribution of the at least one sensor line, keeping the space requirement for the laying device at a minimum in order to be able to utilize the existing space in the mine housing for other purposes, and avoiding sealing problems at the mine housing.

This object has been attained by positioning the at least one laying device outside of the mine housing but in contact with the housing in an initial position, the device is splayed away from the housing in its operative position at an angle of about 45° from the vertical On account of the feature of this invention of arranging the at least one laying device in contact with the mine housing in its or their initial position, it is advantageously possible to maintain the space required for the entire active element during storage and transport, for example, in a missile, at a minimum The distributing, i.e. the laying device, is transferred into its active position only later on, namely at the latest after the mine has assumed its predetermined position in the terrain, and is fixed in this active position, for example, by a locking means. This change from the initial position into the operative position of the laying device can take place, for example, with the aid of pretensioned spring elements or pyrotechnical power elements activated by conventional evaluating and switching units in the mine.

The at least one laying device can be arranged basically in the upper zone, i.e. the zone facing away from the bottom of the terrain, of an essentially cylindrical jacket surface of the mine housing. However, in place thereof, the arrangement on the topside of the mine housing is preferred. In this embodiment, the axes of the laying device and of the mine housing, with the most dense arrangement in the initial position, then stand at least substantially perpendicularly on each other. The laying device is fashioned to be at least approximately rotationally symmetrical, its axial extension being larger than its radial extension. The maximum axial extension of the laying device is no larger than the diameter of the mine housing.

In accordance with an additional feature of the invention, the provision is made of arranging, on the topside of the housing of the mine, several, particularly five, laying devices. Thus, in the most dense arrangement—as seen in the peripheral direction—of the laying devices, an optimum utilization of the space available therefor is made possible. The laying devices are pivotably articulated in this arrangement to a mounting means centrally located on the topside of the mine housing.

For the distribution or placement of the at least one sensor line in the terrain, the provision can be made to dispatch the laying device, with the aid of a charge generating a compressed gas, away from the mine oriented in the upward direction at approximately 45°. However, a structure wherein a propellant charge actuated rocket motor is used to drive the laying device is preferred instead. With the aid of such a tractive drive unit fashioned to be rotationally symmetrical, an especially uniform and gentle placement of the sensor line is attained even over relatively large distances, in that the sensor line is pulled off a coiling reel in an orderly manner under the action of a tensile force exerted by the rocket engine or motor. In this embodiment, the free end of the sensor line is fixedly connected to the evaluating device in the mine housing associated therewith. The pyrotechnical compressed gas unit as well as the rocket engine are triggered by corresponding signals from the evaluating and switching device within the mine after the latter has assumed its predetermined position on the ground of the terrain. It is furthermore advantageous, in case of arranging several laying units on the topside of the mine housing, to design the topside of the tractive drive unit to be curved so that the entirety of all laying devices form, in their operative position, a curved surface similarly to the known deployed cover hoods of hollow-charge mines. As a result, it is reliably avoided that the mine, during its preferred laying from the air, comes to stand on its head, i.e. on the topside of the housing, upon its impingement on the ground of the terrain Instead, the mine then occupies intentionally a lateral position and is righted with the aid of conventional righting elements as described, for example, in DE 1,800,121 C3 into its defined position for the combating of targets.

With a view toward maximally large laying ranges for the sensor lines, it is customary—as indicated above—to eject the lines at an angle of about 45° with respect to the vertical longitudinal mine axis. In order to still further promote this defined "dispatch" of the at least one laying device from the mine housing, a structure including a mandrel, sleeve or other cylindrical launching guide means, proves to be of advantage. This launching guide or guide means ensures the defined orientation of the laying unit precisely in the initial phase of the movement thereof. The additional provision is made that the single laying device or the several laying devices is or are transferred into their operative position by means of the tractive force of a braking parachute of a mine to be distributed from the air, rather than by means of additional spring elements or pyrotechnical power elements, when the parachute is deployed after ejection of the mine from a missile.

The mine with the at least one laying device according to this invention preferably exhibits a ring-shaped universal suspension for the mine housing, the righting elements being articulated to this suspension. This ensures that the mine is oriented perpendicularly with its longitudinal axis even in case of uneven terrain so that the preferred placement of the sensor line at an angle of about 45° with respect to the vertical is ensured. In contradistinction to the conventional righting elements, the laying device is preferably already in its active position upon impingement of the mine on the ground of the terrain. Insofar as the arrangement includes an aerodynamic braking means, especially a parachute, to avoid excessively hard landing of the mine from the air, this braking means is severed from the mine in a conventional manner during or after hitting the ground so that the placement of the sensor line is not impaired by such braking means.

BRIEF DESCRIPTION OF THE DRAWINGS

An embodiment of this invention is illustrated in the accompanying drawings and is described in greater detail with reference thereto, wherein.

DETAILED DESCRIPTION OF THE INVENTION

The mine shown in the FIGURES is designed for automatically combating targets located on the ground from the air. For this purpose,.the mine is oriented in the terrain with the aid of righting elements or devices and preferably has a universal suspension so that the mine points upwards with its topside and the longitudinal axis of the mine is oriented vertically. As soon as signals are received, in this ambush position, via at least one sensor line, which signals can stem from the targets to be combated, the vertically aligned mine is elevated with the aid of a special rocket drive unit to a height of several 100 meters. The mine, dropping on a parachute, then sweeps, while executing a rotary motion, the ground area in a spiral shape with the aid of a special direction-finding sensor acting inclined with respect to the longitudinal axis, and ignites the equally oriented charge of the mine upon recognition of the target to be combated.

Figure 1:
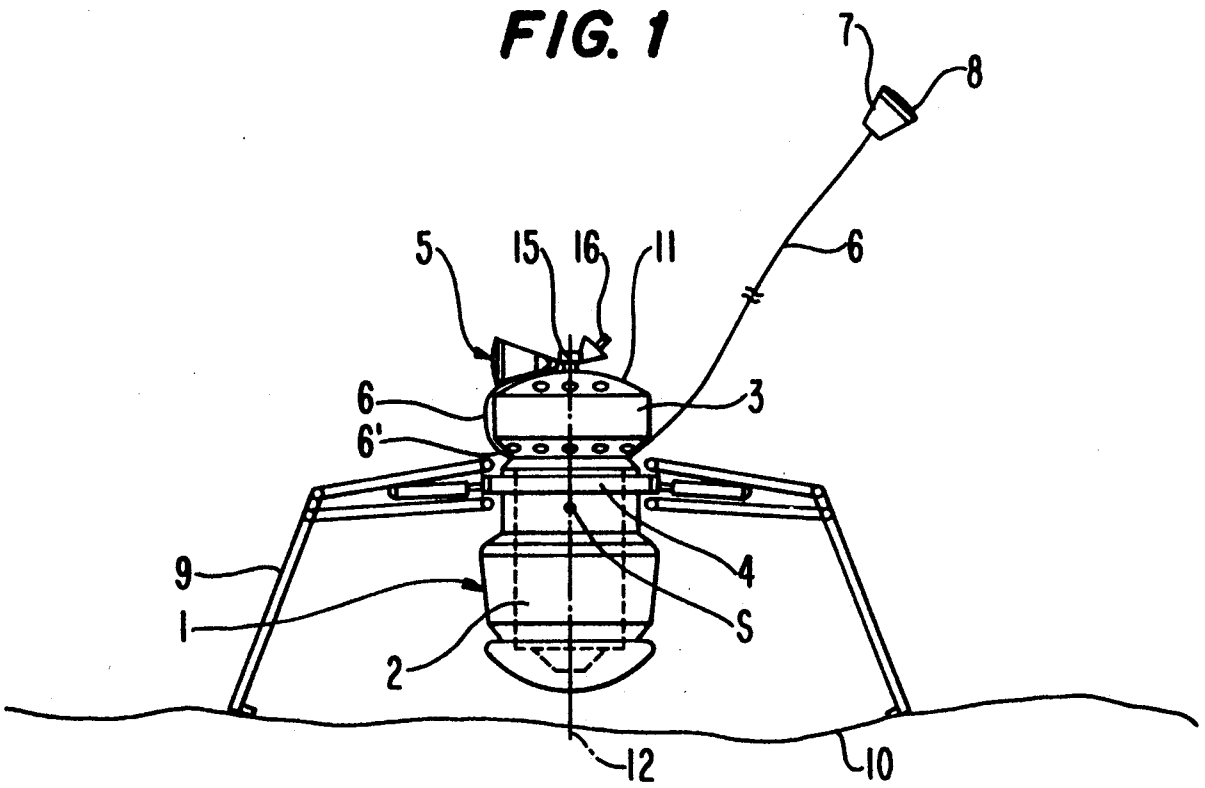
FIG. 1 shows schematically a mine with a laying device, righted in the terrain.

The mine 1 illustrated in FIG. 1 comprises a housing 2 with an active charge arranged therein, a rocket engine 3 for acceleration of the mine in the upward direction and for braking the acceleration of the mine in an apex zone, a universal suspension 4 located above the center of gravity S of the mine 1, a laying device 5 with a sensor line 6 and a casing 7 and the rocket engine 8. The mine 1 is supported on the ground 10 of the terrain with the righting elements 9, the topside 11 of the mine pointing in the upward direction, and the longitudinal axis 12 of the mine being oriented vertically. In the left-hand half of FIG. 1, in a deviation from the normal case, the laying device 5 is shown still in its initial position wherein it is in close contact with the topside 11 of the housing 2 of the mine 1. The laying device in this arrangement is mounted to be pivotable at the central mounting means 15 on the topside 11. The sensor line 6 extends with one of its ends 6' into the mine housing and is fixedly connected with the corresponding evaluating and switching device. This illustration, i.e. the laying device 5 still in its initial position with the mine having already been positioned on the ground of the terrain, does not constitute the normal case insofar as the laying devices are transferred into their operative position preferably even before impingement of the mine 1 on the ground 10 of the terrain This can be seen from the right-hand half of FIG. 1 showing the rear part of the laying device 5 with the launching guide 16 attached thereto, the casing 7 having already been detached therefrom under the tractive effect of the rocket engine 8 wherein the sensor line 6, disposed in the casing 7 as a wound-up coil, has been unwound therefrom and is being pulled by and behind the tractive drive unit 8. The ignition signal from the ignition logic in the mine 1, needed for igniting the rocket engine 8, a small-scale drive unit, can be transmitted either directly after righting of the mine 1 or, alternatively, also only once an approaching target to be combated has been identified, with the aid of a special alarm sensor.

Figure 2:
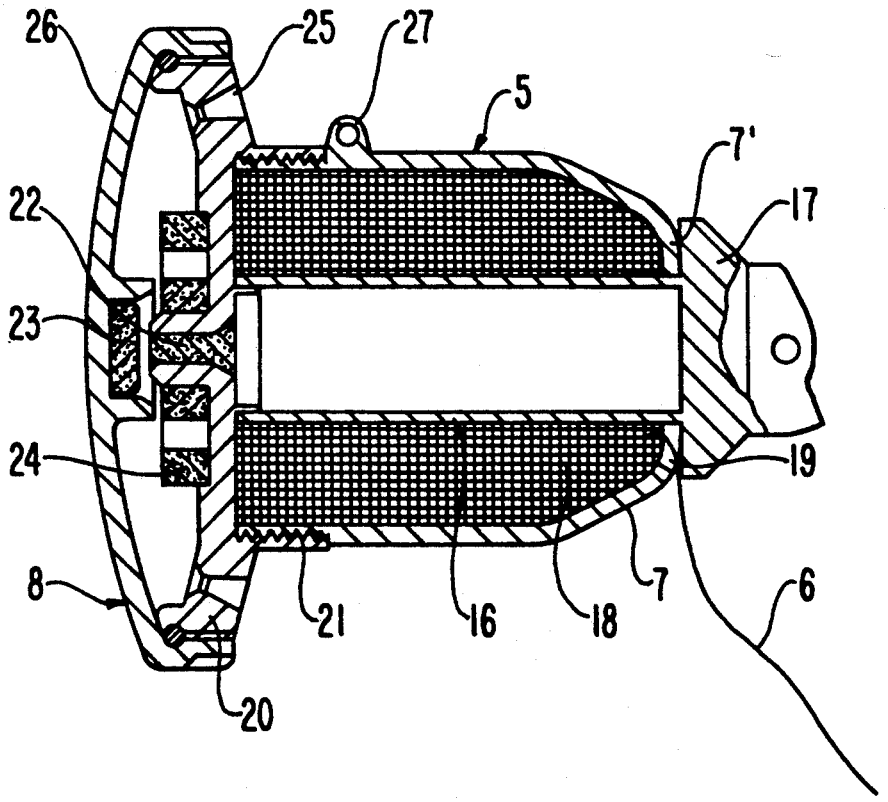
FIG. 2 shows a laying device in a longitudinal sectional view.

The laying device 5 for the sensor line 6 shown in FIG. 2 comprises a substantially hollow-cylindrical casing 7, as well as the rocket engine 8 constructed as a small-scale motor. The launching guide 16 in this case is constructed to be tubular and is integrally joined to the base member 17 serving for the pivotable mounting of the laying device 5 to the mounting means 15. The casing 7 exhibits a bottom 7' on its end facing the base member 17; this bottom has a cutout in the form of a circular disk, with an inner diameter corresponding to the outer diameter of the tubular launching guide 16 so that, upon ignition of the rocket engine 8, the laying device 5 with its casing 7 is perfectly guided on the launch guide 16 and is pulled away toward the left in the illustration. Within the casing 7, the wound-up coil 18 made up of the reeled-up sensor line 6, is illustrated only partially. The sensor line 6 is fixedly joined to the laying device 5 with its end located within the laying device and, with its other end, is extended by way of the perforation or opening 19 in the bottom 7' of the casing out of the casing and to the housing 2 of the mine 1. The housing 20 of the rocket engine 8 is connected to the casing 7 via a threaded connection 21. An igniter element 22 triggerable by the ignition logic of the mine, an igniter mixture 23, and a propellant charge 24 are arranged within the housing 20. On the underside of the housing 20, pointing toward the base member 17, the housing is provided with nozzles 25 arranged in the manner of a wreath. The other side of the rocket engine, facing away from the oasing 7, is shaped as a surface 26 which is curved in the manner of a spherical shell. The eye 27 integrally joined to the casing 7 serves for the fastening of a line of the parachute as will be explained in greater detail, with reference to the FIGS. 3 to 6.

The casing 7 is in this arrangement has the shape of a truncated cone in its rearward zone facing the bottom part 7' in order to be able to arrange, in a deviation from the illustration in FIG. 1, several, preferably five, laying devices on the topside 11 of the mine 1 in a maximally dense "packing" in the initial position, and thus to be able to accommodate, with a minimum height of the mine, an optimum number of sensor lines with corresponding distributing devices As a result, these mines occupy a comparatively small volume during storage and, for example, their transport by means of a missile, and yet optimum distribution of the sensor lines is ensured after positioning of the mine in the terrain. The range of placement of the sensor lines 6 is here set by the configuration of the propellant charge 24 and the type of propellant utilized therefor.

Figure 3:
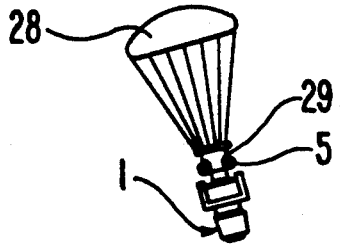
FIGS. 3 to 6 show schematically successive phases in the distribution of a mine from the air.

According to FIG. 3, the mine 1, ejected in the air from a tubular transport container, for example the carrier portion of a rocket, floats to the ground while being suspended on the parachute 28. The parachute 28 engages the laying device 5 by way of the rope 29 extended through the eye 27 of the laying device 5 and has righted the laying device 5 already by about 45°, i.e. has brought it into its operative position.

Figure 4:
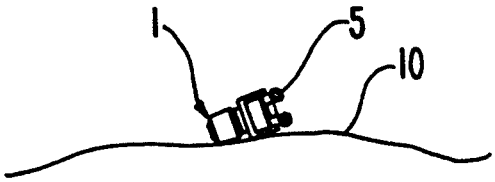

FIG. 4 shows the mine 1 lying on its side on the ground 10 of the terrain The parachute 28 has been detached from the mine 1 in a conventional way and has already been removed. The laying device 5 which are in the operative position and of which only two are shown here for reasons of simplifying the illustration, form a hood-like rolling surfaces on the topside of the mine 1, preventing the mine from coming to rest on the ground 10 of the terrain with its head-side end since in such a case righting into the desired predetermined position, i.e. pointing upwardly with the head side, by means of the conventional righting devices, would no longer be possible.

Figure 5:
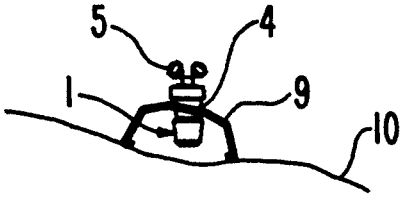

In FIG. 5, the mine 1 is shown in the intended predetermined position, i.e. in vertical arrangement and pointing upwards with the head side. With the aid of the universal suspension 4 to which the righting elements 9 are articulated, the mine 1 assumes this position even with an uneven ground 10 of the terrain.

Figure 6:
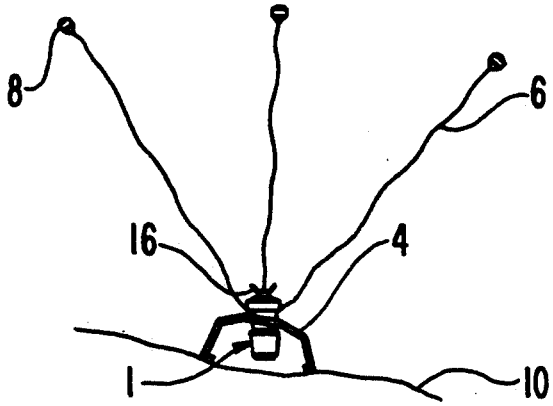

Once the righting process has been completed, all sensor lines 6 are distributed, in correspondence with FIG. 6, in each case pulled by a rocket engine 8, simultaneously and in a defined fashion into differing directions. The initial inclination of the rocket engines 8 amounts herein to about 45° with respect to the vertical Insofar as the laying devices are mounted on the topside of the mine 1, impairment due to vegetation in the terrain is at a minimum during the laying of the sensor lines. After the sensor lines 6 have been placed, the height of the mine 1 and thus also its radar signature are diminished. Furthermore, also the starting mass for the retro-rocket engine 3 of the mine 1 is reduced since, during starting, the sensor lines 6 with the casing 7 and the small-scale drive unit 8 are severed. Finally, the design of the mine housing is simpler inasmuch as there occur practically no sealing problems.

What is claimed is:

1. A mine comprising a housing with an underside and a topside operatively associated with at least one laying device for the placement of a sensor line after the mine has assumed a predetermined position on the terrain, wherein the sensor line, during a placement step, moves away from the housing at least in an initial phase under an angle of about 45° oriented in the upward direction, characterized in that the housing has mounting means for positioning the laying device so that the device is arranged outside of the housing of the mine and is in contact with the topside of the housing in an initial position, and mounting means including a pivotable support means for said laying device so that the laying device, in its operative position, is splayed away from the housing under an angle of about 45° and is fixed in said operative position.

2. A mine according to claim 1, characterized in that an aerodynamic braking unit is operatively associated with said mounting means so that the laying device is transferred from the initial position into the operative position under the tensile force of the aerodynamic braking unit upon being deployed, said braking unit including a parachute of the mine.

3. A mine according to claim 1, characterized in that the laying device is arranged on the topside of the housing and, in its initial position, is in intimate contact with the topside.

4. A mine according to claim 3, characterized in that said housing has a topside with an essentially circular-disk-shaped configuration and several laying devices are provided distributed uniformly over the periphery of the housing, the laying devices, in plan view, forming a configuration similar to a circular segment.

5. A mine according to one of claims 1 to 4, characterized in that the laying device comprises a casing for the accommodation of the sensor line wound up in the manner of a coil, said casing being provided on an end facing away from the housing of the mine, in the operative position, with a rocket engine having a nozzle wreath arranged around the casing, said rocket engine, after activation, moving upwardly and laterally away from the housing and pulling the casing off the housing of the mine and thus exerting a tensile force on the sensor line retained with one of its ends at the mine, the movement of the rocket engine and associated casing placing the sensor line in a working location on the terrain.

6. A mine according to claim 5, characterized in that the rocket engine exhibits, on a free side facing away from the casing, a surface curved in the manner of a sperical shell so that, with laying devices being in the operative position, said laying devices jointly constitute a curved rolling surface for the head end of the housing of the mine.

7. A mine according to claim 5, characterized in that said mounting means comprises a cylindrical guide means connected pivotably to the housing of the mine, sad guide means acting as a launching guide for the laying device during upward movement of the rocket engine, the casing, together with the wound-up coil of the sensor line, being placed onto said guide means.

* * * * *